US006551002B1

(12) United States Patent
Puglisi

(10) Patent No.: US 6,551,002 B1
(45) Date of Patent: Apr. 22, 2003

(54) DECORATIVE SLEEVE HOLDER IN COMBINATION WITH A DECORATIVE WRITING INSTRUMENT

(75) Inventor: Marc Puglisi, Fairfield, NJ (US)

(73) Assignee: Ben S. Loeb, Inc., fairfield, NJ (US)

( * ) Notice: Subject to any disclaimer, the term of this patent is extended or adjusted under 35 U.S.C. 154(b) by 0 days.

(21) Appl. No.: 10/119,336

(22) Filed: Apr. 9, 2002

(51) Int. Cl.[7] ..... B43K 23/00

(52) U.S. Cl. ..... 401/195; 401/52; 401/88; 401/131; D19/36; D19/42; D19/77; D19/82; 15/435

(58) Field of Search ..... 401/155, 52, 88, 401/131; D19/36, 42, 43, 77, 81, 82; 482/44; D3/206; 206/24, 37, 371; 24/10 R, 10 CT, 11 HC, 11 F

(56) References Cited

U.S. PATENT DOCUMENTS

D76,034 S * 8/1928 Morgan ..... D19/36
D172,025 S * 4/1954 Hopstein ..... D19/36
3,510,949 A * 5/1970 Crhirsty ..... 33/27.01
3,918,579 A * 11/1975 Diamant ..... 206/306
D275,744 S * 10/1984 McJunkin et al. ..... D11/157
4,753,346 A * 6/1988 Tsuji ..... 206/371
4,834,372 A * 5/1989 Velazquez ..... 273/147
4,986,685 A * 1/1991 Kiyokane ..... 401/213
5,158,384 A * 10/1992 Radmilovic et al. ..... 401/195
5,259,095 A * 11/1993 Tam ..... 24/10 R
D418,869 S * 1/2000 Nussinow et al. ..... D19/42
6,241,413 B1 * 6/2001 Puck et al. ..... 401/131

* cited by examiner

*Primary Examiner*—Gregory L. Huson
*Assistant Examiner*—Huyen Le
(74) *Attorney, Agent, or Firm*—Howard C. Miskin, Esq.; Gloria Tsui-Yip, Esq.

(57) ABSTRACT

A holder in combination with a writing instrument comprises a writing instrument having a decorative end opposite the writing end and a holder comprises a sleeve having decorative and/or advertising material printed thereon. The writing instrument is inserted into the sleeve to be held in an upright position such that the decorative end of the writing instrument and the decorative design on the sleeve coordinate with each other to provide an interesting and entertaining combination.

19 Claims, 4 Drawing Sheets

DECORATIVE SLEEVE HOLDER IN COMBINATION WITH A DECORATIVE WRITING INSTRUMENT

FIELD OF THE INVENTION

The invention relates to a decorative holder in combination with a writing instrument that protects a pocket from a writing end, attracts attention and has decorative, entertaining and marketing values.

BACKGROUND OF THE INVENTION

All writing instruments, such as pens and pencils, generally have a writing tip at one end of an elongated cylindrical body that provides minimal surface area for decoration or advertisement. Only limited sized text and graphics may be placed on a writing instrument because the surface is curved and is not flat.

Writing instruments are generally held in an upright position in a cup-shaped holder, a base having a cap attached thereon whose shape and size corresponds to that of the writing instrument, or a base having an opening whose shape and size correspond to that of the writing instrument. These holders are generally weighted or of a substantial size to properly hold the writing instrument in an upright position.

Prior art writing instruments also have minimal entertaining value.

Therefore, there is a need for a holder in combination with a writing instrument, that provides entertaining, decorative and marketing values that is light and inexpensive to manufacture.

SUMMARY OF THE INVENTION

The present invention provides a holder in combination with a writing instrument that has entertaining, decorative and marketing values.

The holder of the present invention in combination with a writing instrument comprises a writing instrument preferably having a decorative end opposite the writing tip end and a holder comprises a sleeve for receiving the writing instrument having decorative and/or advertising material printed thereon. The writing instrument can be held in an upright position when it is inserted into the sleeve of the holder, keeping the writing tip covered and with the decorative end of the writing instrument outside the sleeve. With the writing instrument in the holder, the decorative end of the writing instrument and the decoration on the sleeve preferably coordinate with each other to provide an interesting and entertaining combination. For example, a head mounted on the end of the writing instrument protruding from the top of the sleeve and a body printed on the sleeve produces a unique, different appearance. Writing instruments with different decorative ends and sleeves with different coordinated decorations may be mixed and matched to provide additional entertainment values. When the sleeve is not used as a holder, it can also be used as a bookmark.

BRIEF DESCRIPTION OF THE DRAWINGS

A preferred embodiment of the present invention has been chosen for purposes of illustration and description and is shown in the accompanying drawings forming a part of the specification wherein.

DETAILED DESCRIPTION OF THE PREFERRED EMBODIMENTS

Figure 1:
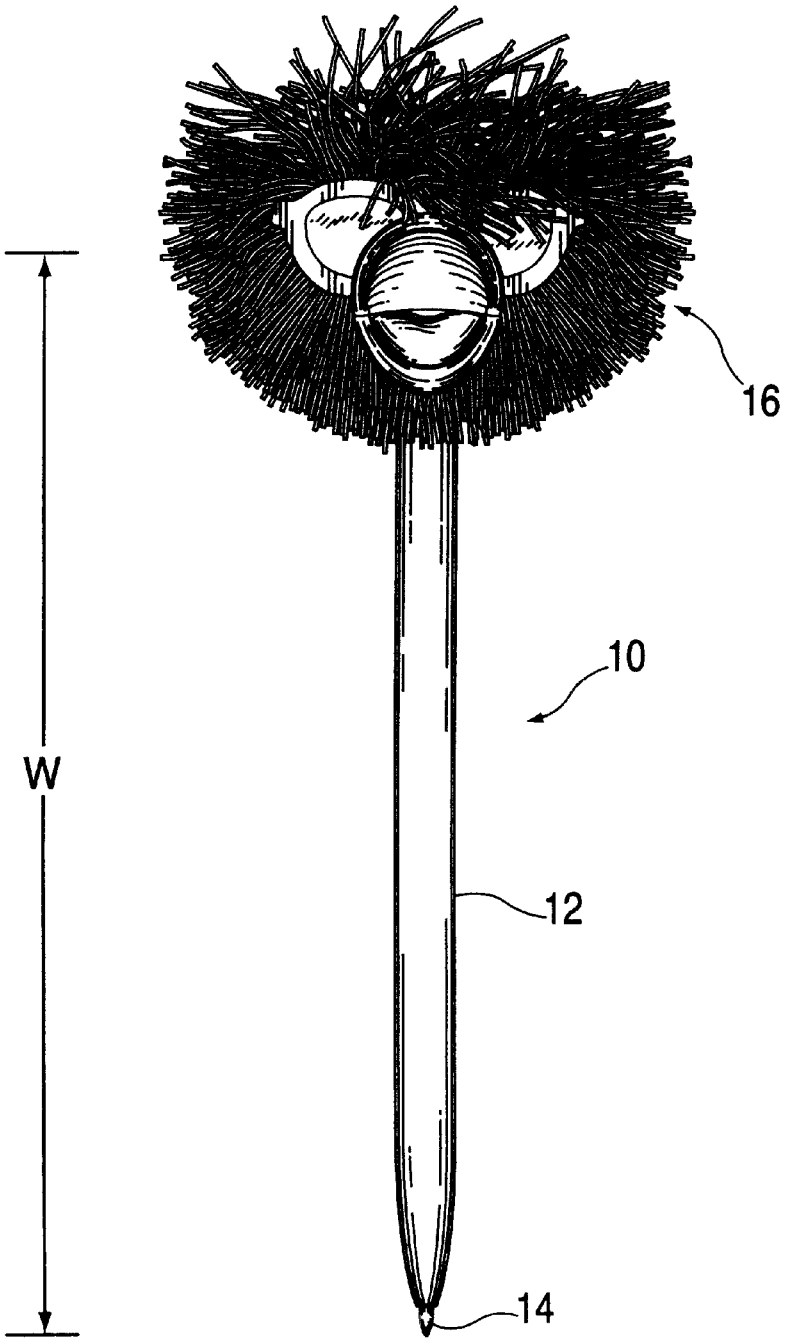
FIG. 1 is a writing instrument having an illustrative decorative end opposite the writing tip end, according to the present invention.

With reference to the drawings, wherein the same reference number indicates the same element throughout, there is shown in FIG. 1 a writing instrument 10 showing an embodiment of the present invention having an elongated body 12 with a writing tip end 14 and an opposite decorative end 16. As shown, for illustrative purposes, the decorative end 16 preferably is in the form of a head with features on the face, as shown in FIG. 1.

Figure 3:
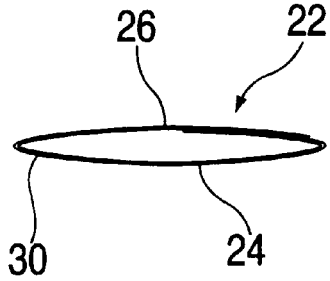
FIG. 3 is a top view of the holder of the present invention.
Figure 4:
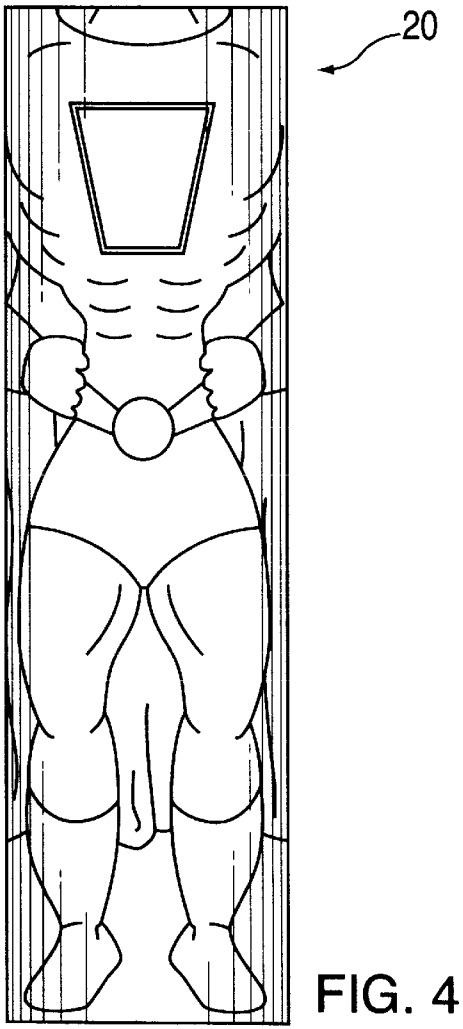
FIGS. 4–6 are examples of holders of the present invention with different decorations.
Figure 2:
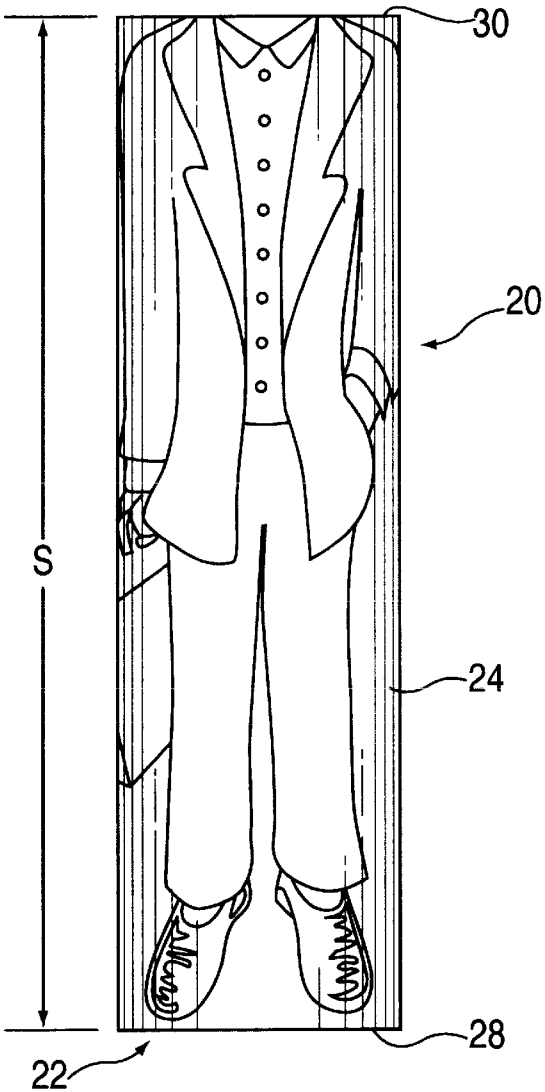
FIG. 2 is a front view of a holder according to the present invention.
Figure 6:
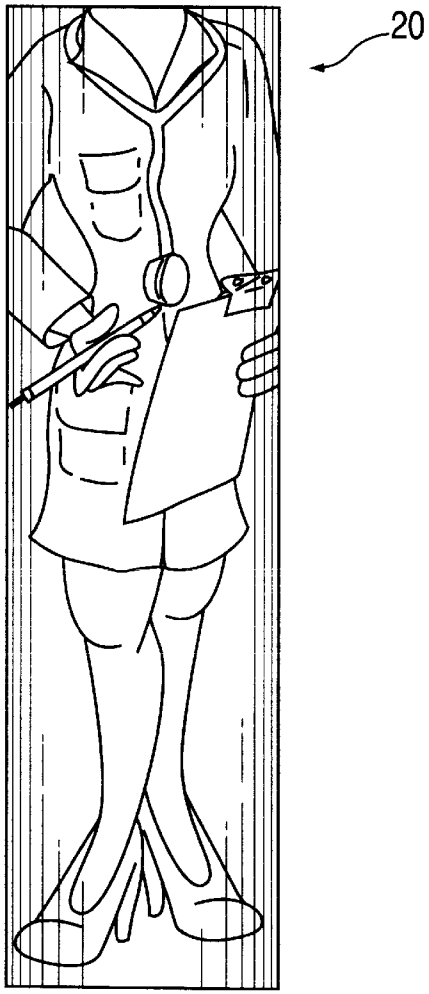
Figure 5:
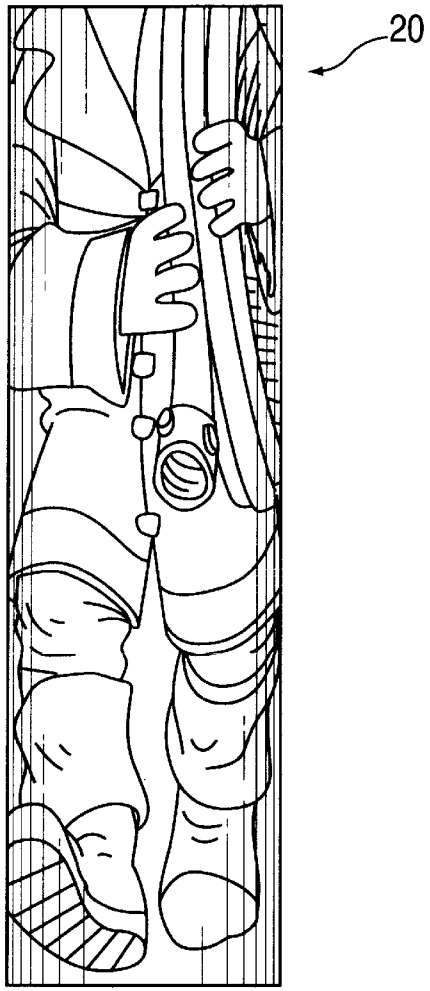

As shown in FIGS. 2 and 3, a holder 20 of the present invention comprises a sleeve 22 illustratively shown as rectangularly shaped, having a front panel 24 and a rear panel 26 that is substantially flat. On the front panel 24 of the sleeve 22 is a decorative design, such as a body form as shown in FIG. 2. Although FIG. 2 shows a body form of a man in a suit, other body forms such as a superhero (FIG. 4), a fireman (FIG. 5) or a nurse (FIG. 6) can be used. Other decorative designs, such as advertisement and other text and graphics may be printed, sprayed, silk screened, etc. thereon. Decorative designs can be placed on just one of the panels 24 and 26 or on both panels 24 and 26. with the front and rear panels 24 and 26 having different designs.

The shape of the sleeve 20 is not limited to rectangular shape as shown in FIGS. 2, 4, 5 and 6, and can have any contoured shapes. The holder 20 is preferably made from cardboard material, for stiffness, ease of printing and low cost of manufacture, but can be made from similar material, such as plastic, vellum, paper, etc., known to one skilled in the art. Due to the flatness of the holder 20, it can also be used as a bookmark.

Figure 7:
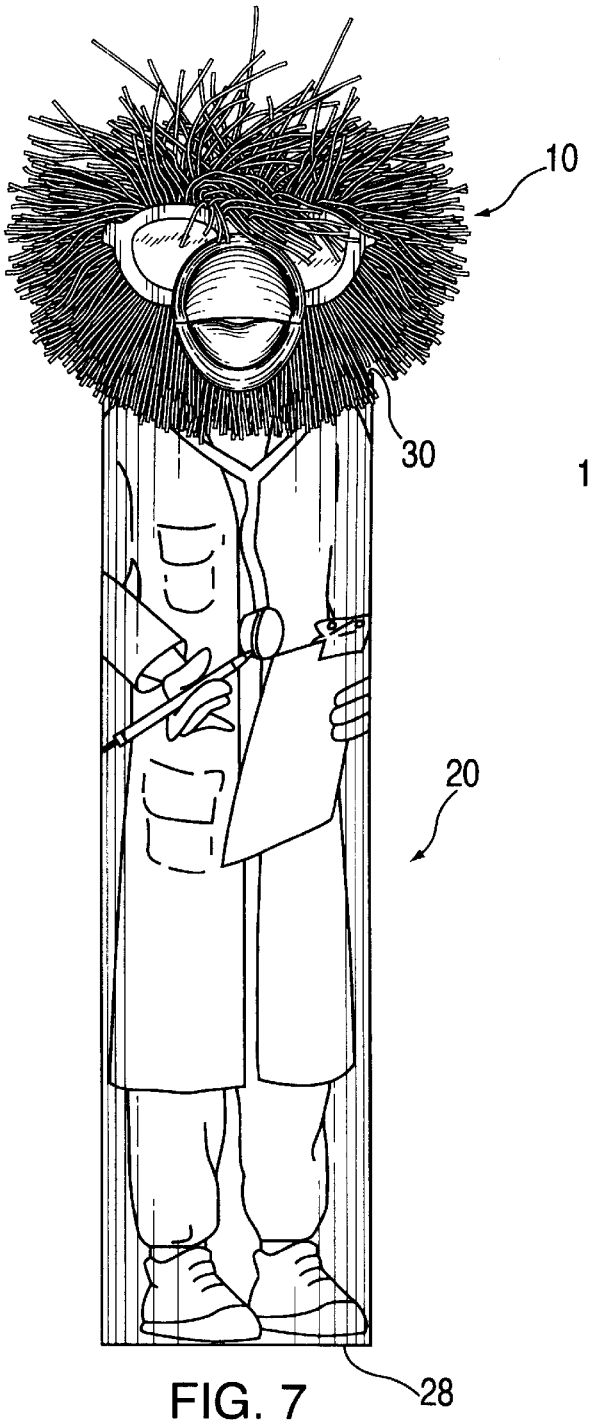
FIG. 7 is the combination of a writing instrument and sleeve holder of the present invention.
Figure 8:
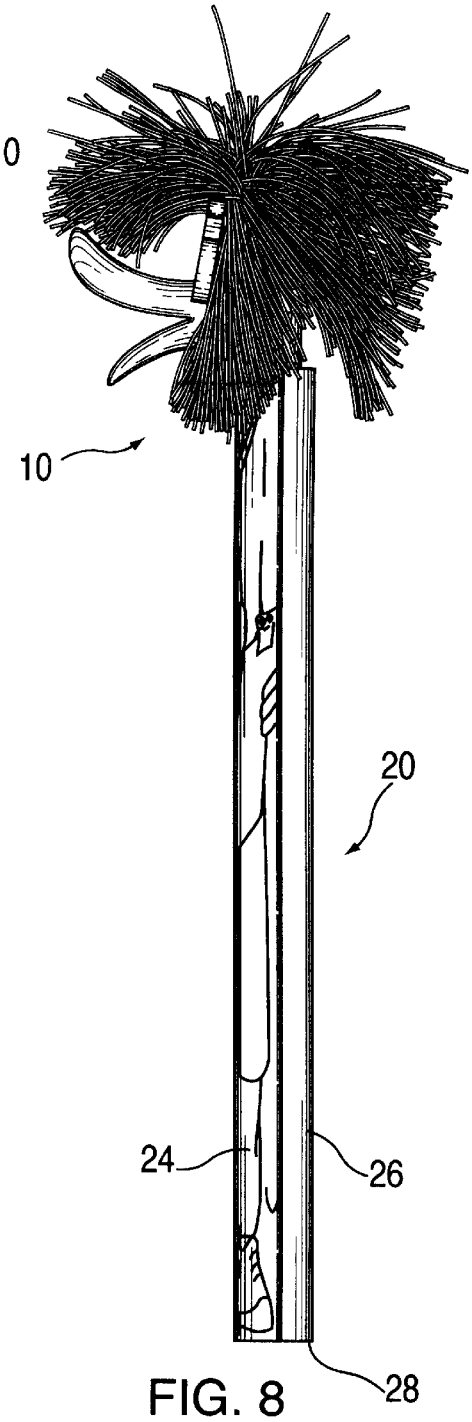
FIG. 8 is a side view of the combination of a writing instrument and sleeve holder of the present invention.

FIGS. 7 and 8 show the writing instrument 10 held in an upright position by the holder 20. The length S of the sleeve 20 is preferably longer than the length W of the body 12 of the writing instrument 10, such that the writing tip end 14 of the writing instrument 10 will not extend beyond the bottom edge 28 of the sleeve 22 to possibly stain a pocket of the user. The sleeve 22 of the holder 20 is expanded to form a gap between the front and rear panels 24 and 26 to accommodate the writing instrument 10. When the writing instrument 10 is placed within sleeve 22 of the holder 20, the enlarged decorative end 16 of the writing instrument rests against the top edge 30 of the sleeve 22. With the decorative end 16 of the writing instrument 10 in the head form and the front panel 24 of the holder 20 in the body form create an interesting and entertaining visual effect. The writing instrument 10 shown in FIG. 1 can be selectively placed in any one of the holders shown in FIGS. 2, 4, 5 and 6 for additional entertaining values.

Although certain features of the invention have been illustrated and described herein, other better modifications and changes will occur to those skilled in the art. It is, therefore, to be understood that the appended claims are intended to cover all such modification and changes that fall within the spirit of the invention.

What I claim is:

1. A combination writing instrument and holder comprises:

(a) a writing instrument comprises a body with a writing end and an opposite decorative end; and (b) a holder comprises an expandable and substantially flat sleeve having at least a front panel with a first decorative design thereon;

(c) wherein when said body of said writing instrument is placed within said sleeve, said decorative end of said writing instrument rests outside said sleeve such that the decorative end coordinates with said decorative design on said holder.

2. The combination of claim 1, wherein said decorative end is in the form of a head.

3. The combination of claim 1, wherein said holder is rectangular shape.

4. The combination of claim 1, wherein said decorative design is in the form of a body.

5. The combination of claim 1, wherein said decorative design contains text and graphics.

6. The combination of claim 1, wherein said decorative design is printed on said front panel.

7. The combination of claim 1, wherein said sleeve further having a rear panel with a second decorative design.

8. The combination of claim 1, wherein said holder has a contoured shape.

9. The combination of claim 1, wherein said holder is made from cardboard.

10. The combination of claim 1, wherein said body having a predetermined length and said holder having a predetermined length longer than said length of said body.

11. A holder for a writing instrument having a body with a writing end and an opposite decorative end, comprising an expandable and substantially flat sleeve having at least a front panel with a first decorative design thereon, said sleeve is adapted to hold said writing instrument such that said decorative end of said writing instrument rests outside said sleeve such that said decorative design on said holder is adapted to coordinate with said decorative end of said writing instrument.

12. The holder of claim 11, wherein said holder is rectangular shape.

13. The holder of claim 11, wherein said decorative end of said writing instrument is in the form of a head and said decorative design is in the form of a body.

14. The holder of claim 11, wherein said decorative design contains text and graphics.

15. The holder of claim 11, wherein said decorative design is printed on said front panel.

16. The holder of claim 11, wherein said sleeve further having a rear panel with a second decorative design.

17. The holder of claim 11, wherein said holder has a contoured shape.

18. The holder of claim 11, wherein said holder is made from cardboard.

19. The holder of claim 11, wherein said body of said writing instrument having a predetermined length and said sleeve having a predetermined length longer than said length of said body.

* * * * *